United States Patent [19]

Coetzee

[11] 3,960,351

[45] June 1, 1976

[54] REFUSE DEVICES

[76] Inventor: Chris Coetzee, 199 Riverton Ave., Clubview, Verwoerdburg 0140, South Africa

[22] Filed: Oct. 10, 1974

[21] Appl. No.: 513,589

Related U.S. Application Data

[63] Continuation-in-part of Ser. No. 411,256, Oct. 31, 1973, abandoned.

[52] U.S. Cl. ..... 248/101; 248/97

[51] Int. Cl.[2] ..... A47G 29/06; B65F 1/06

[58] Field of Search ..... 248/95–101, 248/147, 128, 134, 149, 150; 211/71, 82, 83, 84; 312/211, 212; 232/43.2; 220/30, 32, 35, 36, 1 T, 33

[56] References Cited

UNITED STATES PATENTS

| | | | |
|---|---|---|---|
| 2,269,257 | 1/1942 | Edwards | 248/97 |
| 3,226,070 | 12/1965 | Kurlander | 248/97 |
| 3,374,976 | 3/1968 | Kurlander et al. | 248/97 |
| 3,595,507 | 7/1971 | Kurlander | 248/97 |
| 3,610,560 | 10/1971 | Dillabough | 248/97 |
| 3,655,157 | 4/1972 | Dalton | 248/97 |
| 3,695,565 | 10/1972 | Hodges | 248/97 |
| 3,836,037 | 9/1974 | Bass | 211/83 X |

*Primary Examiner*—Roy D. Frazier
*Assistant Examiner*—Terrell P. Lewis
*Attorney, Agent, or Firm*—Fred Wiviott

[57] ABSTRACT

The invention relates to a supporting device for a disposable refuse pocket, e.g. of paper or plastics.

The device includes parts to which the mouth of the pocket is releasably attached. These parts are preferably spring-loaded towards each other so as to keep the mouth of the pocket closed. Handle or pedal means serve to move these parts apart so as to open the mouth of the pocket against the spring bias. The device has its own base for mounting on a floor.

The device serves for the hygienic and aesthetic disposal of refuse in domestic, office, hotel, openair or industrial environments.

4 Claims, 7 Drawing Figures

REFUSE DEVICES

BACKGROUND OF THE INVENTION

This is a continuation-in-part of my co-pending patent application Ser. No. 411,256 dated Oct. 31, 1973, now abandoned.

This invention relates to a supporting device for a disposable refuse pocket of a flexible material comprising a supporting frame adapted for the releasable attachment of the edge of the mouth of the pocket.

The applicant has given consideration to one such device in the form of a wire framework adapted for plastics shopping bags to be supported therein, suspended from their handles, with the mouth of the bag permanently open. Such an arrangement has hygienic and aesthetic drawbacks. Disposable plastics or paper liners for conventional dustbins are known. In that case the lid of the bin contacts the refuse. In the longer term dirt will accumulate on the surfaces of the dustbin itself, necessitating periodical washing. The dustbin itself is comparatively expensive.

It is an object of the present invention to provide a novel refuse device which when the teachings of the present specification are applied judiciously, may offer a variety of advantages as compared with the prior art, in particular in respect of hygiene and convenience. Preferred embodiments are aesthetically pleasing and can be made comparatively inexpensively. Various embodiments of the invention may be adapted to a variety of uses such as for use instead of prior art dustbins, as waste paper containers, as refuse containers for camping, as refuse devices for bathrooms and conveniences, as refuse devices for industrial use and other purposes which may become apparant from the following description.

SUMMARY OF THE INVENTION

In accordance with the invention there is provided a supporting device for a disposable refuse pocket of a flexible material comprising a supporting frame adapted for the releasable attachment of the edge of the mouth of the pocket, said supporting frame, comprising a first, stationary supporting member and a second, movable supporting member, wherein each of the supporting members comprises a cross strut for the attachment thereto of a part of the mouth of the pocket, these cross struts being movable towards and away from one another between an open and a closed position, such that in the closed position the struts are parallel, placed one against the other, and in the open position they are parallel and spaced apart, wherein the cross struts each interconnect two arms of the respective supporting member, corresponding arms of the two supporting members being hinged to one another about a common hinge axis remote from and parallel to the cross struts, the movable supporting member comprising a pedal means for opening the receptacle against a spring bias wherein the arms of the stationary supporting member are connected with a base and the arms of both the stationary and the movable supporting members are connected at their upper ends by the respective cross struts, the pedal means being provided by a third cross strut interconnecting the arms of the movable supporting member, wherein the spring bias is provided by a substantially rectilinear elongate spring element fixed to the base and bearing against a part of the movable supporting member, adapted to exert the spring bias, and wherein each supporting member comprises at least one clamp adapted to clamp portion of the mouth of the pocket when that portion of the mouth has been folded over the cross strut of the supporting member, each clamp being pivotally connected with the supporting member at a position removed from the cross strut sufficiently to permit the fold-over of the mouth of the pocket.

The disposable pockets are preferably made of paper-like plastics film which is particularly light, thin and strong. These films are for example made in manners known per se from high density polyethylene. They are preferably substantially opaque. They can be provided in attractive colours and/or patterns. However, it would also not be in conflict with the spirit of the invention if the supporting frame included baffle means for at least partly obscuring the bag from view.

The scope of the invention is intended to include the supply of disposable receptacles such as plastics bags with instructions or recommendations, e.g. written instructions to use such receptacle with a device in accordance with the invention.

REFERENCE TO THE DRAWINGS

Further preferred features of the invention will become apparent from the following description of the invention with reference to the drawings.

In the drawings the preferred embodiment of the invention is shown:

FIG. 1 is a perspective view of the supporting device,

FIGS. 2 and 3 are a side elevation and front elevation respectively of the device showing the position for the pocket mouth to be closed, FIG. 4 is a side elevation of the device showing the position for the pocket mouth to be open, FIG. 5 is a side elevation of a plurality of like devices nested for packaging/storage purposes, and FIGS. 6 and 7 are perspective views of the (open) mouth of a pocket showing respectively before and after securing the pocket with the clamps.

DESCRIPTION OF PREFERRED EMBODIMENTS

Figure 1:
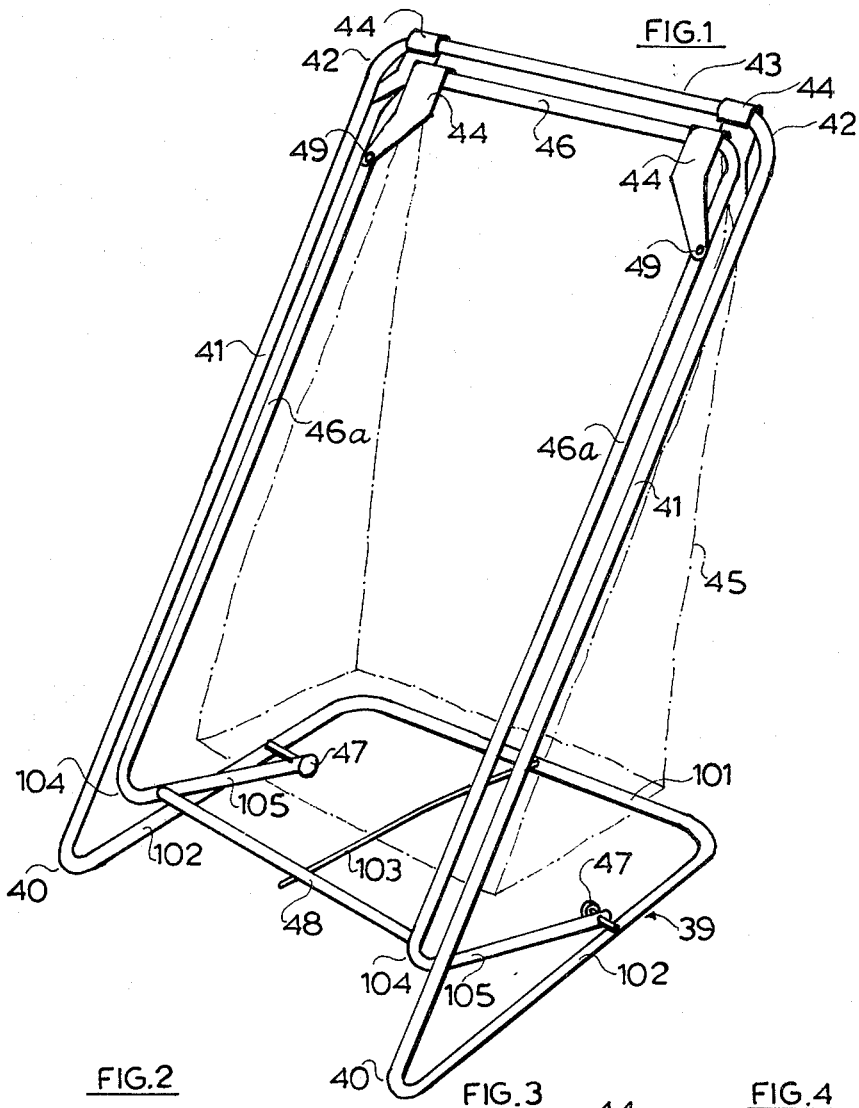

Referring to FIG. 1 of the accompanying drawings, the particular embodiment shown comprises a base 39 of metal rod bent in a U-shape, the ends of the metal rod being bent upwards at 40 to form arms 41 which are bent around at 42 and joined together to form a horizontal first cross strut 43 equipped with clamps 44 for holding in place one part of the mouth of a bag 45 foled over the first cross strut 43. The base 39 comprises a fourth cross strut 101 interconnecting two foot members 102. The single metal rod forming the base 39, arms 41 and cross strut 43 constitutes the first, stationary frame member of the supporting frame of the device.

A second cross strut 46 forms part of a second movable frame member bent from metal rod material. The second cross strut 46 connects the upper ends of two elbow-shaped arms 46a. The lower end of each elbow is hinged to the base by pin joints 47. The two elbow arms 46a are interconnected near the apexes 104 of the elbows by a third cross member 48 serving as a pedal. A rectilinear elongate spring element, simply, a straight spring wire 103 is fixed to the fourth cross strut 101 by its end being inserted with a tight fit into a hole drilled into the strut 101. This spring 103 bears against the underneath of the cross strut 48 and thereby provides spring bias tending to bring the movable frame member to the position shown in which the pocket 45 mouth is closed.

The cross member 46 is similarly equipped with clamps 44 pin-jointed to the arms 46a at 49 serving to hold in place another part of the mouth of the flexible pocket 45.

Figure 2:
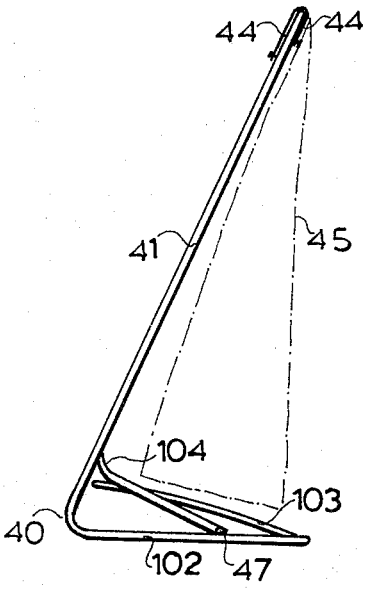
Figure 3:
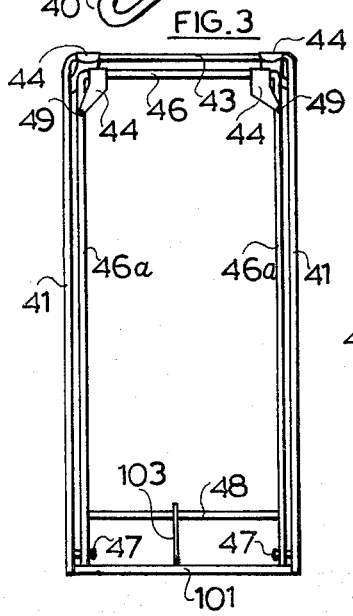
Figure 4:
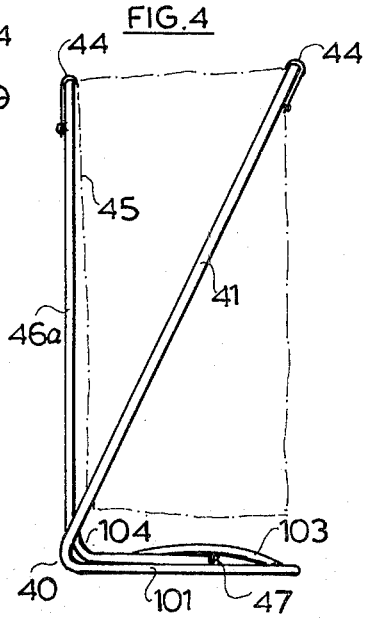

Referring now to FIGS. 2 to 4:

The pedal means (third cross member 48) is offset against the imaginary plane shared by the second cross strut 46 and the hinge axis represented by hinge pins 47. Accordingly, if foot pressure is applied to the pedal means 48, the elbow arms 46a will pivot, thereby to move the second cross strut 46 away from the first cross strut 43 and to cause opening of the mouth of the pocket 45, as shown in FIG. 4. When pressure is released, the pocket mouth will be closed automatically by virtue of the spring bias exercised by torsion spring 103, as shown in FIG. 2.

Figure 5:
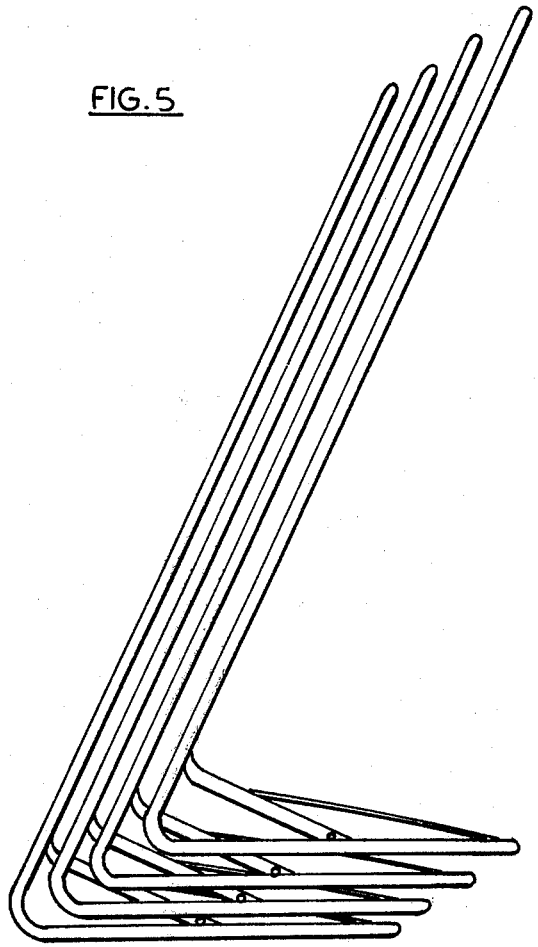

As shown in FIG. 5, a plurality of like devices can be nested together which is convenient for packaging, e.g. when delivering to a store for merchandising. In this context it will be noted by reference to the preceding figures that the arms 46*a* and cross strut 46 of the movable supporting member lie in the same imaginary plane as the arms 41 and cross strut 43 of the stationary supporting member, when in the position in which the pocket mouth is closed, i.e. the "closed position". This fact and further the fact that the lower portions 105 remain in the same relative inset position as the arms 46a from the arms 41 and feet 102 of the stationary supporting member permits adapting the device to be capable of being nested. Preferably 10 devices will be nested and containerised for transport to retail stores and other destinations.

Figure 6:
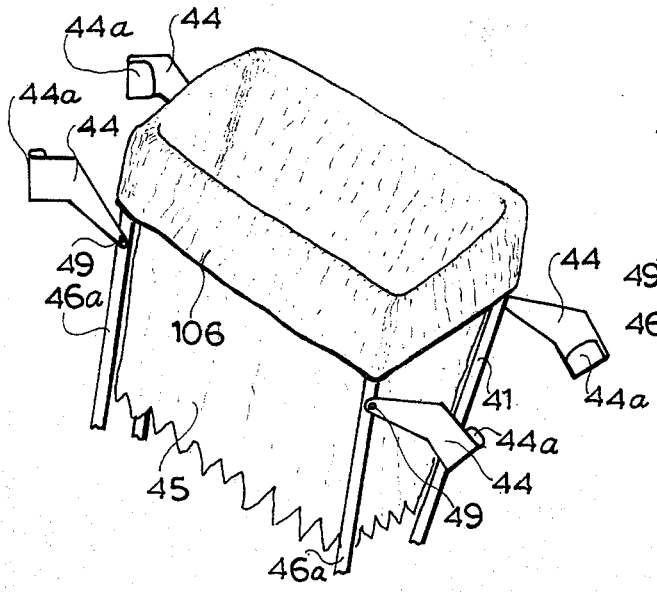
Figure 7:
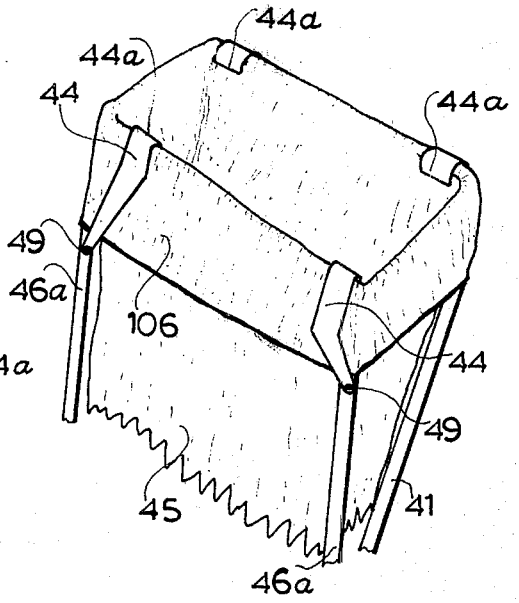

Referring to FIGS. 6 and 7 it is specifically pointed out that the clamps 44 by virtue of being fixed by pivots 49 to the arms 41 and 46*a* cannot become easily lost, as in the case of loose clamps. Further the pivots 49 are located not on or near the cross struts 43 and 46, but at positions removed from the cross struts sufficiently to permit the fold-over 106 of the pocket 45. Further, the gripping portions 44*a* of the clamps 44 are joined with the portions at the pivot 49 by parts which are located only on one outer side of each of the supporting members constituted by the arms 46*a* and cross strut 46 and by the arms 41 and cross strut 43 respectively (see also FIG. 1). The term "outer sides" means those sides which remain on the outside when the device is in the open position - see the clamps 44 on the view of FIG. 4. In this way the pocket fold-over 106 does not interfere with the clamps 44 when the clamps 44 are in the clamping positions.

The clamps 44 on the arms 41 act as limit stops for the movement of the arms 46*a* (see e.g. FIGS. 1 and 3).

What is claimed is:

1. Supporting device for a disposable refuse pocket of a flexible material having an open mouth, said supporting device comprising a supporting frame adapted for the releasable attachment of the edge of the mouth of the pocket, said supporting frame comprising a first, stationary supporting member and a second movable supporting member, each of the supporting members comprises a pair of arms and an interconnecting cross strut, said cross struts being adapted for the attachment thereto of a part of the mouth of the pocket, corresponding arms of the two supporting members being hinged to one another about a common hinge axis remote from and parallel to the cross struts, said movable supporting member being movable towards and away from the stationary supporting member between an open and a closed position, such that in the closed position the struts are generally parallel and in engagement, and in the open position they are generally parallel and spaced apart, the cross struts respectively connecting the upper ends of the arms of both the stationary and the movable supporting members, a third cross strut interconnecting the arms of the movable supporting member to provide a pedal for the movable supporting member, a foot member affixed to each of the arms of the stationary supporting member, a fourth cross strut interconnecting the foot members to provide a base, a substantially rectilinear elongate spring element fixed to the fourth cross strut and bearing against the third cross strut to provide a spring bias against movement of the movable supporting member towards its open position, each supporting member including at least one clamp adapted to clamp portion of the mouth of the pocket when that portion of the mouth has been folded over the cross strut of the supporting member, the arms of the movable supporting member each being elbow shaped and pivoted at one end with the stationary supporting member, the third cross strut being fixed to the arms of the movable member near the apexes of the elbows.

2. A supporting device as claimed in claim 1, in which the arms and cross struts of the movable supporting member lie in the same plane as the arms and cross strut of the stationary supporting member, when in the closed position, the supporting frame being constructed and arranged so as to be nestable with other like supporting frames.

3. A supporting device as claimed in claim 2, in which the clamps of the stationary supporting member act, when in their clamping positions, as limit stops to limit movement of the movable supporting member under action of the spring element.

4. Supporting device for a disposable refuse pocket of a flexible material having an open mouth, said supporting device comprising a supporting frame adapted for the releasable attachment of the edge of the mouth of the pocket, said supporting frame comprising a first, stationary supporting member and a second movable supporting member, each of the supporting members comprises a pair of arms and an interconnecting cross strut, said cross struts being adapted for the attachment thereto of a part of the mouth of the pocket, corresponding arms of the two supporting members being hinged to one another about a common hinge axis remote from and parallel to the cross struts, said movable supporting member being movable towards and away from the stationary supporting member between an open and a closed position, such that in the closed position the struts are generally parallel and in engagement, and in the open position they are generally parallel and spaced apart, the cross struts respectively connecting the upper ends of the arms of both the stationary and the movable supporting members, a third cross strut interconnecting the arms of the movable supporting member to provide a pedal for the movable supporting member, a base interconnecting the arms of the stationary supporting member, a substantially rectilinear elongate spring element fixed to the base and bearing against the movable supporting member to provide a spring bias against movement of the movable supporting member towards its open position, each supporting member including at least one clamp adapted to clamp portion of the mouth of the pocket when that portion of the mouth has been folded over the cross strut of the supporting member, each clamp being pivotally mounted on its associated supporting member at a position sufficiently remote from the cross struts thereof to permit the mouth of the refuse pocket to be folded over said cross struts, said clamps being located on the outer side of its respective supporting member and including a gripping portion shaped to curl over a region of the cross strut, when the clamp is in the clamping position.

* * * * *

UNITED STATES PATENT OFFICE

CERTIFICATE OF CORRECTION

Patent No. 3,960,351 Dated June 1, 1976

Inventor(s) Chris Coetzee

It is certified that error appears in the above-identified patent and that said Letters Patent are hereby corrected as shown below:

Claim 1, Column 4, Line 25, after "movable" insert --supporting--.

Signed and Sealed this

Seventh Day of September 1976

[SEAL]

*Attest:*

RUTH C. MASON
*Attesting Officer*

C. MARSHALL DANN
*Commissioner of Patents and Trademarks*